US011738963B2

(12) United States Patent
Takano

(10) Patent No.: US 11,738,963 B2
(45) Date of Patent: Aug. 29, 2023

(54) IMAGE FORMING APPARATUS

(71) Applicant: KYOCERA Document Solutions Inc., Osaka (JP)

(72) Inventor: Yusuke Takano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 311 days.

(21) Appl. No.: 17/274,217

(22) PCT Filed: Jul. 9, 2019

(86) PCT No.: PCT/JP2019/027192
§ 371 (c)(1),
(2) Date: Mar. 8, 2021

(87) PCT Pub. No.: WO2020/054198
PCT Pub. Date: Mar. 19, 2020

(65) Prior Publication Data

US 2021/0347595 A1 Nov. 11, 2021

(30) Foreign Application Priority Data

Sep. 13, 2018 (JP) ..... 2018-171584

(51) Int. Cl.
*B65H 31/26* (2006.01)
*B65H 29/24* (2006.01)
*B65H 31/38* (2006.01)

(52) U.S. Cl.
CPC ..... *B65H 31/26* (2013.01); *B65H 29/245* (2013.01); *B65H 31/38* (2013.01); *B65H 2404/5211* (2013.01)

(58) Field of Classification Search
CPC ..... B65H 29/247; B65H 31/26
See application file for complete search history.

(56) References Cited

U.S. PATENT DOCUMENTS 4,372,550 A * 2/1983 Woods ..... B65H 29/70 271/211
4,702,468 A * 10/1987 Pollich ..... B65H 29/247 271/211

(Continued)

FOREIGN PATENT DOCUMENTS

JP 2000318246 A * 11/2000
JP 2010-132372 A 6/2010

*Primary Examiner* — Howard J Sanders
(74) *Attorney, Agent, or Firm* — Studebaker & Brackett PC

(57) ABSTRACT

An image forming apparatus (1) includes a discharge port (25), a sheet stacking plate (41), a pair of cursors (43), a cursor driver (95), a pair of blowers (83) and a controller (37). Through the discharge port (25), a sheet formed an image is discharged. On the sheet stacking plate (41), the sheet discharged through the discharge port (25) is stacked. The pair of cursors (43) is supported on the sheet stacking plate (41) in a slidable manner in width directions perpendicular to a discharge direction of the sheet and comes into contact with both side edges of the sheet. The cursor driver (95) drives the pair of cursors (43). The pair of blowers (83) is provided in the pair of cursors (43) so as to blow air to both corners on an upstream side in the discharge direction of the sheet which is discharged through the discharge port (25), from above. The controller (37) controls the cursor driver (95) and the pair of blowers (83).

8 Claims, 10 Drawing Sheets

(56) References Cited

U.S. PATENT DOCUMENTS

| | | | | |
|---|---|---|---|---|
| 11,084,679 | B2 * | 8/2021 | Tsuchiya | B65H 31/38 |
| 2015/0353315 | A1 * | 12/2015 | Suzuki | B65H 43/04<br>271/194 |

* cited by examiner

IMAGE FORMING APPARATUS

TECHNICAL FIELD

The present invention relates to an image forming apparatus including a discharge tray provided with a cursor.

BACKGROUND

In an image forming apparatus, a sheet on which an image is formed is discharged by a discharge device, and then stacked on a discharge tray. When the sheet is discharged, the front end portion and the rear end portion of the sheet may curl upward owing to various kinds of factors. If the sheet curls in the above manner, misalignment of the sheet occurs when the sheet is stacked on the discharge tray.

As a method for preventing such misalignment, there is a method of providing the discharge device with a corrugation mechanism for pressing the sheet and imparting stiffness to the sheet or with a mechanism for pressing the rear end portion of the sheet immediately after the sheet is discharged, or a method for forming a convex shape on the discharge tray to correct the sheet after the sheet is discharged. However, in a case where stiffness is imparted to the sheet, the correction effect may be lost after the sheet passes through the discharge device. In a case where the convex shape is formed on the discharge tray, the sheet may be deformed according to the convex shape.

Alternatively, in an image forming apparatus described in patent literature 1, an upper fan and a lower fan are provided above and below the discharge means, and the rotation of the upper fan and the lower fan is controlled in response to the position of a recording medium (the sheet) to be discharged on the discharge tray.

PRIOR ART DOCUMENT

Patent Literature

[Patent literature 1] JP2010-132372

SUMMARY

Problems to be Solved by the Invention

However, in the image forming apparatus described in the patent literature 1, the upper fan and the lower fan are disposed in the center portion in the width directions of the sheet. Then, when the rear portion of the sheet curls, it is difficult to send air over all area of the sheet in the width directions, and the curl of the side portions of the sheet may not be corrected suitably.

It is therefore an object of the present invention to provide an image forming apparatus capable of properly correcting a curl of a discharged sheet.

Means for Solving the Problems

In accordance with an aspect of the present invention, an image forming apparatus includes a discharge port, a sheet stacking plate, a pair of cursors, a cursor driver, a pair of blowers and a controller. Through the discharge port, a sheet formed an image is discharged. On the sheet stacking plate, which the sheet discharged through the discharge port is stacked. The pair of cursors is supported on the sheet stacking plate in a slidable manner in width directions perpendicular to a discharge direction of the sheet and comes into contact with both side edges of the sheet. The cursor driver drives the pair of cursors. The pair of blowers is provided in the pair of cursors so as to blow air to both corners on an upstream side in the discharge direction of the sheet which is discharged through the discharge port, from above. The controller controls the cursor driver and the pair of blowers.

Effect of the Invention

According to the present invention, it becomes possible to blow air to both side end portions of the discharged sheet surely. Therefore, both curled side end portions of the sheet are pressed downward so that it becomes possible to correct the curl from the side end portions to the center portion.

THE EMBODIMENT FOR CARRYING OUT THE INVENTION

Hereinafter, with reference to the attached drawings, an image forming apparatus according to one embodiment of the present invention will be described.

Figure 1:
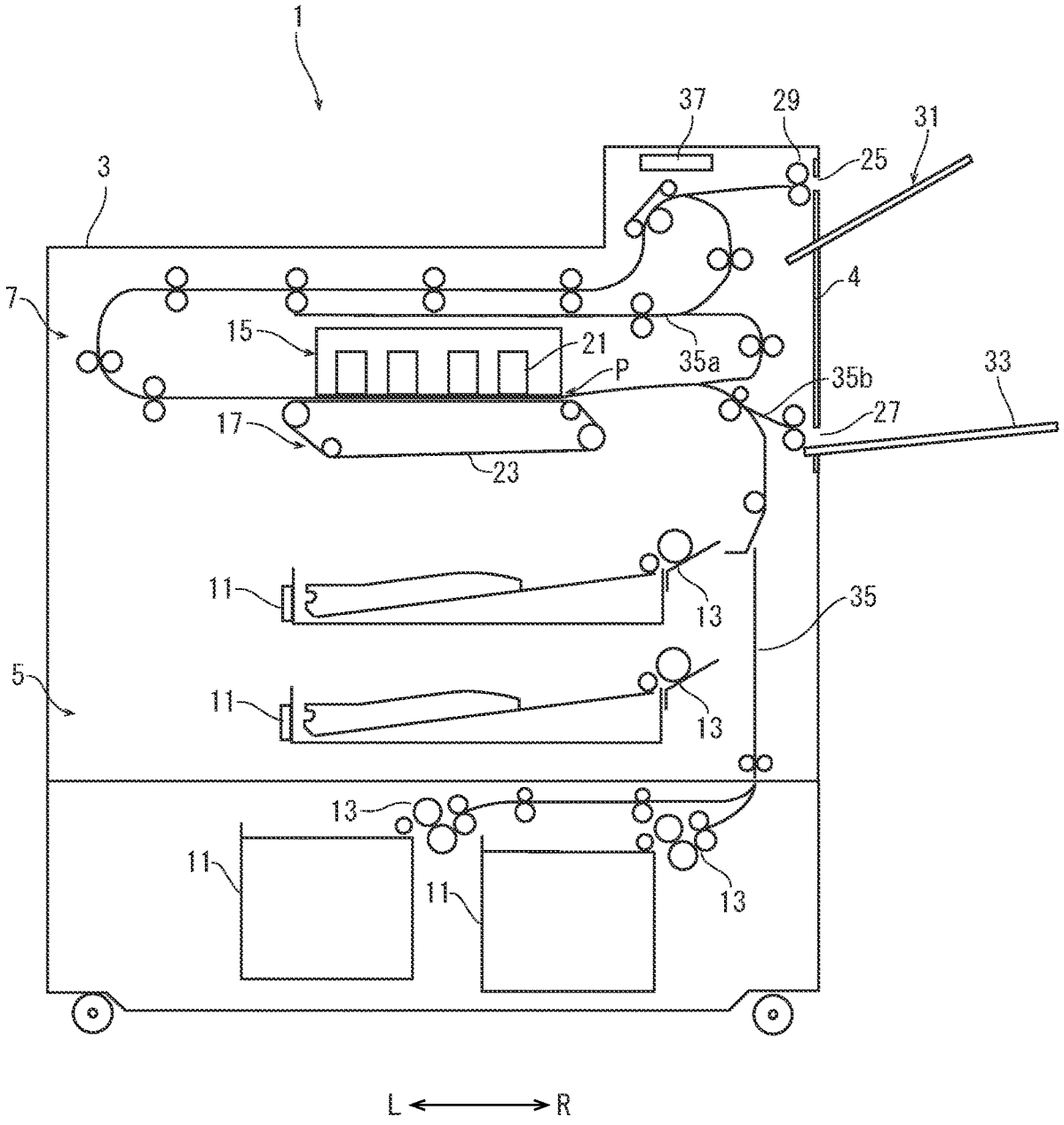
FIG. 1 is a front view schematically showing an inner structure of an image forming apparatus according to one embodiment of the present invention.

With reference to FIG. 1, the image forming apparatus 1 will be described. FIG. 1 is a front view schematically showing an inner structure of the image forming apparatus 1 (at an image formation). A near side of a paper surface on which FIG. 1 is drawn is defined as a front side of the image forming apparatus 1. "L" and "R" marked in each figure respectively show a left side and a right side of the image forming apparatus 1.

An apparatus main body 3 of the image forming apparatus 1 includes a sheet feeding part 5 and an inkjet type image forming part 7. The sheet feeding part 5 is provided in the lower portion of the apparatus main body 3, and includes a plurality of sheet feeding cassettes 11 in which a sheet S is stored and a plurality of sheet feeding devices 13 by which the sheet S is fed from respective sheet feeding cassettes 11. The image forming part 7 is provided in the upper portion of the apparatus main body 3, and includes a head unit 15 and a conveyance unit 17.

The head unit 15 includes four line heads 21 corresponding to four colors (yellow, magenta, cyan and black) of the ink. The four line heads 21 are disposed side by side in the left-and-right direction. The four line heads 21 are connected to ink tanks (not shown) in which the corresponding inks are stored.

The conveyance unit 17 includes a circulating conveyance belt 23. The conveyance belt 23 is wound around a pair of rollers, and circulates in the counterclockwise direction in FIG. 1. Between the conveyance belt 23 and the line heads 21 of the head unit 15, an image forming path P is formed.

On the upper portion of the right side surface of the apparatus main body 3, an almost upright discharge wall 4 is formed. In the discharge wall 4, a sheet discharge port 25 and a manual sheet feeding port 27 are formed in parallel via a distance in the upper-and-lower direction. Inside the discharge port 25, a discharge rollers pair 29 is disposed. The discharge rollers pair 29 includes a drive roller driven by a motor and a driven roller. When the drive roller is driven to be rotated, the sheet S is discharged. After the sheet is discharged, the drive roller is stopped. On the discharge wall 4, a discharge tray 31 is provided below the discharge port 25, and a manual sheet feeding tray 33 is provided below the manual sheet feeding port 27.

Furthermore, inside the apparatus main body 3, a conveyance path 35 for the sheet S is formed. The conveyance path 35 is formed between the sheet feeding devices 13 of the sheet feeding part 5 to the discharge port 25 through the image forming path P. On the conveyance path 35, a switch back path 35*a* is formed so as to branch from the conveyance path 35 on a downstream side of the image forming path P and to join to the conveyance path 35 on an upstream side of the image forming path P in the conveyance direction. Between the manual sheet feeding port 27 and a portion on an upstream side of the joining portion between the switch back path 35*a* and the conveyance path 35, a manual sheet conveyance path 35*b* is formed. Further, the apparatus main body 3 includes a controller 37 which performs an image forming operation and a sheet conveyance operation described below.

Next, the image forming operation of the image forming apparatus 1 shown in FIG. 1 will be described. Firstly, the sheet is fed from the sheet feeding cassette 11 to the conveyance path 35 by the corresponding sheet feeding device 13. Alternatively, the sheet placed on the manual sheet feeding tray 33 is fed to the manual sheet conveyance path 35*b* through the manual sheet feeding port 27 and then to the conveyance path 35. The fed sheet S is conveyed to the image forming path P along the conveyance path 35. Through the image forming path P, the inks are ejected from the line heads 21 to form an image on the sheet S. The sheet S on which the image is formed is conveyed along the conveyance path 35, discharged through the discharge port 25 by the discharge rollers pair 29 and then stacked on the discharge tray 31. In a case of both-side printing, the sheet S having an image on one side surface is conveyed to the switchback path 35*a*, the front and back side surfaces of the sheet S are inverted, and after the image is formed on the other side surface, the sheet is discharged through the discharge port 25 by the discharge rollers pair 29 and then stacked on the discharge tray 31.

Figure 2:
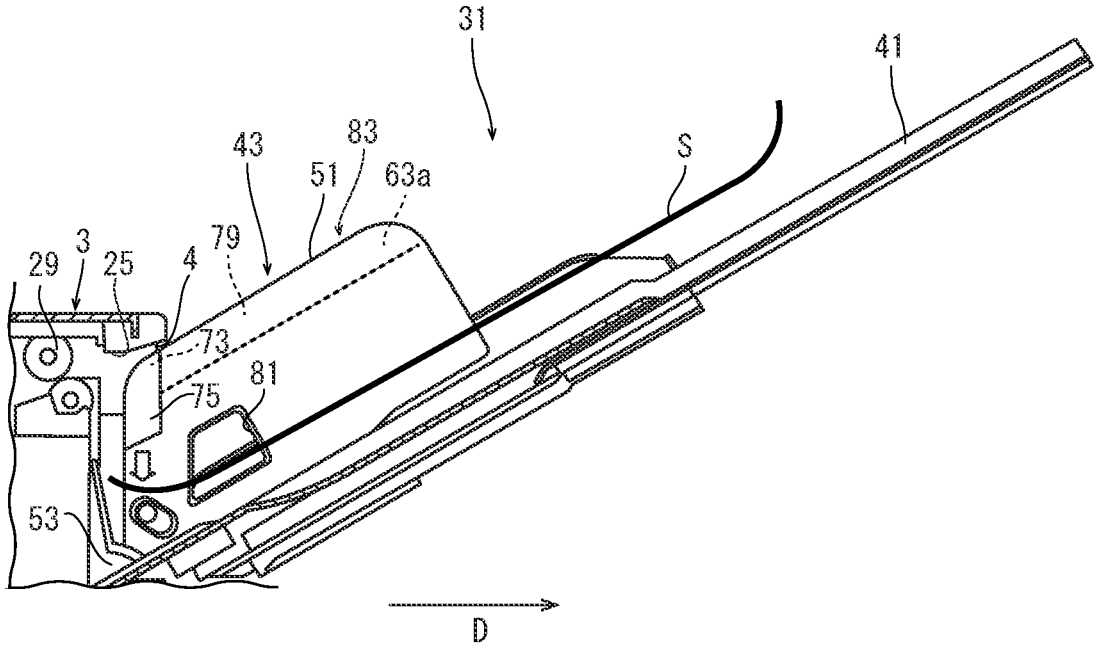
FIG. 2 is a sectional view showing a discharge tray, in the image forming apparatus according to the embodiment of the present invention.

Next, the discharge tray 31 will be described with reference to FIG. 2. FIG. 2 is a side view showing the discharge tray.

The discharge tray 31 includes a sheet stacking plate 41 and a pair of cursors 43.

As shown in FIG. 2, the sheet stacking plate 41 is supported on the discharge wall 4 of the apparatus main body 3 below the discharge port 25 so as to be inclined obliquely upward.

Figure 3:
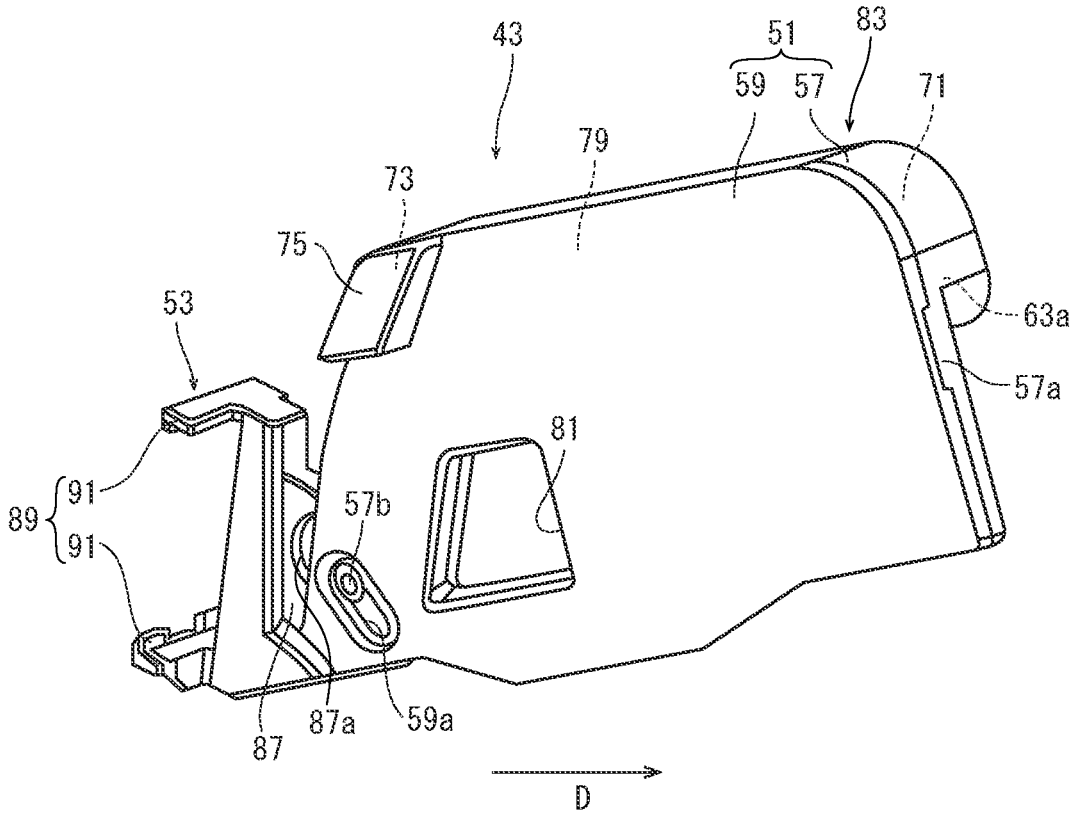
FIG. 3 is a perspective view showing a cursor, in the image forming apparatus according to one embodiment of the present invention.

The pair of cursors 43 will be described with reference to FIG. 3 to FIG. 5, in addition to FIG. 2. FIG. 3 is a perspective view showing the cursor, FIG. 4 is a disassembled perspective view showing the cursor, and FIG. 5 is a sectional view showing the pair of cursors.

Figure 4:
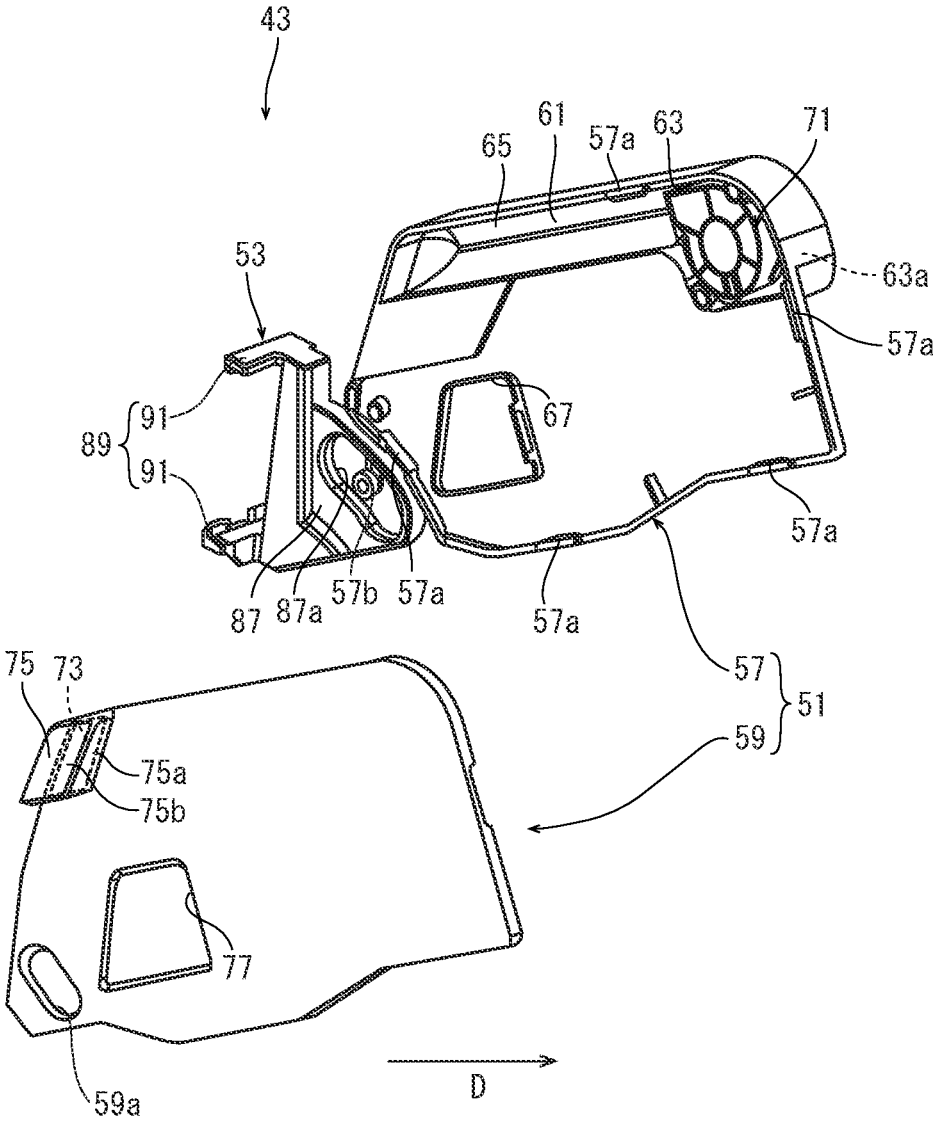
FIG. 4 is a disassembled perspective view showing the cursor, in the image forming apparatus according to one embodiment of the present invention.
Figure 5:
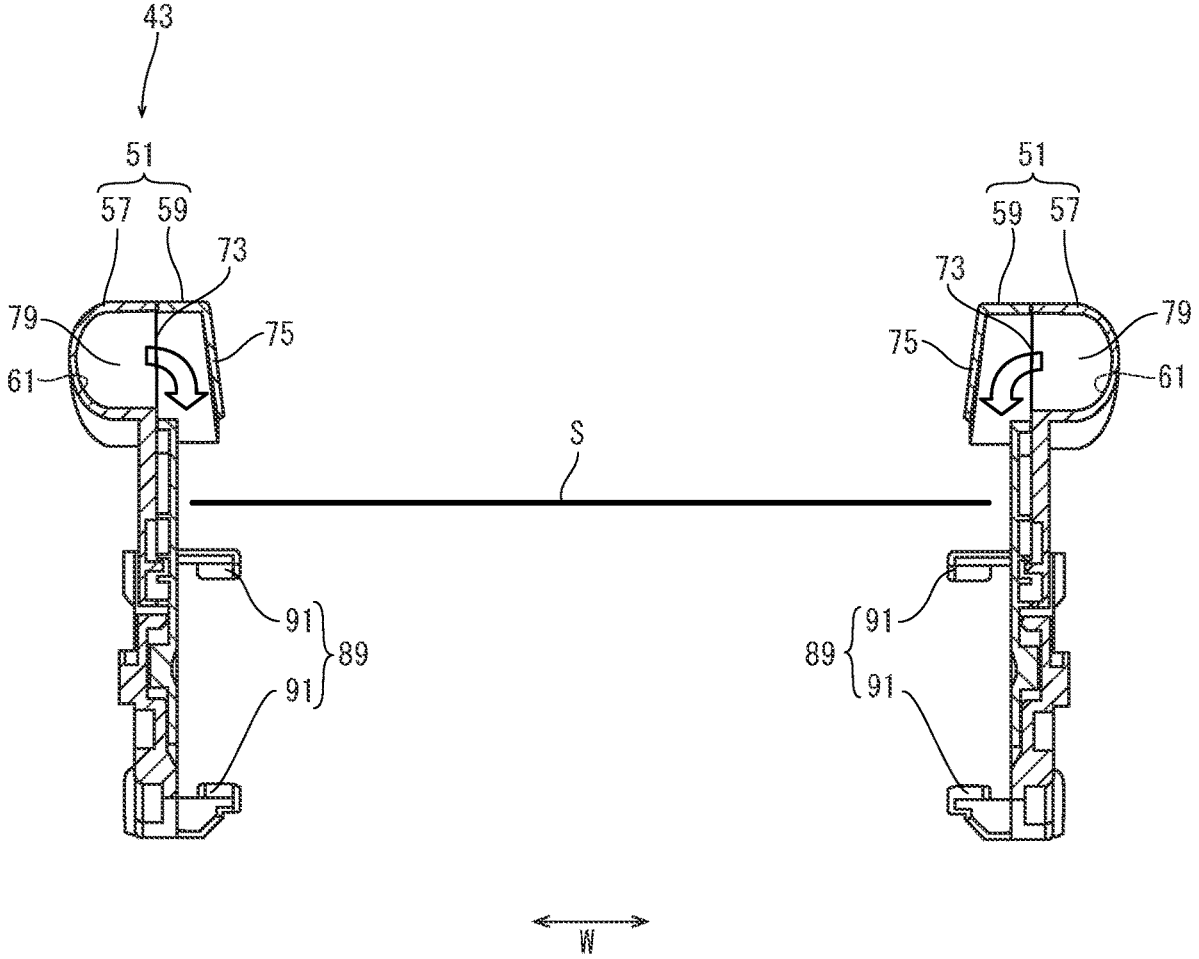
FIG. 5 is a sectional view showing a pair of the cursor, in the image forming apparatus according to the embodiment of the present invention.

As shown in FIG. 3 and FIG. 4, the cursor 43 has a main body part 51 and a coupling part 53. As shown in FIG. 5, the cursors 43 are disposed on the sheet stacking plate 41 so as to face each other in a width directions W perpendicular to a sheet discharge direction D.

The main body part 51 is an approximately parallelepiped member extending in the discharge direction D, and formed by an outer plate 57 and an inner plate 59. The outer surface of the inner plate 59 forms an alignment surface with which a side edge of the sheet comes into contact. Around the outer circumferential edge of the outer plate 57, claws 57*a* are formed at predetermined intervals. The claws 57*a* are engaged with the outer circumferential edge of the inner plate 59, so that the outer plate 57 and the inner plate 59 are coupled to each other.

As shown in FIG. 4, on the outer plate 57 (the outer side surface of the main body part 51 in the width directions W), a recessed portion 61 protruding outward in the width directions W is formed along the upper edge. The recessed portion 61 has an approximately cylindrical fan storage part 63 and an air passage 65. The fan storage part 63 is formed in the downstream side end portion in the discharge direction D. The air passage 65 extends upstream from the fan storage part 63 in the discharge direction D. In the lower surface of the fan storage part 63, an intake port 63*a* is formed. The outer plate 57 further has a rectangular opening 67 below the upstream side end portion of the air passage 65. In addition, on the inner surface of the outer plate 57 (the surface facing the inner plate 59), a projection 57*b* is formed at the upstream side lower corner.

In the fan storage part 63, a blower fan 71 is stored as a fan to take in air through the intake port 63*a*. The blower fan 71 is disposed such that its intake port is communicated with the intake port 63*a* and its blowing port is communicated with the air passage 65. The blower fan 71 is connected to a power source provided in the apparatus main body 3 with a wire (both are not shown). The wire is wired in the main body part 51.

In the inner plate 59 (the inner surface of the main body part 51 in the width directions W), a first blowing port 73 is formed at the upstream side upper corner portion in the discharge direction D. On the outer surface (the surface opposite to the outer plate 57) of the inner plate 59, a hood 75 is protruded so as to guide air blown through the first blowing port 73 downward. In detail, the hood 75 has a side wall 75*a* stood along the upper edge and both side edges of the first blowing port 73 and an opposite wall 75*b* facing the first blowing port 73. Further, the inner plate 59 has a rectangular opening 77 on a slightly downstream side of a portion below the first blowing port 73. Furthermore, the inner plate 59 has an opening 59*a* at the upstream side lower corner portion.

When the outer plate 57 and the inner plate 59 are coupled to each other as described above, as shown in FIG. 3, a duct 79 is formed between the recessed portion 61 of the outer plate 57 and the inner plate 59 so as to extend from the intake port 63*a* to the first blowing port 73. Then, when the blower fan 71 is driven, outside air is taken into the duct 79 through the intake port 63*a*. The taken in air is sent through the duct 79, and then blown downward through the first blowing port 73 by the hood 75. Additionally, when the outer plate 57 and the inner plate 59 are coupled to each other, both openings 67 and 77 are communicated with each other, and forms a wind releasing hole 81 penetrating the cursor in the thickness direction (penetrating between the outer surface and the inner surface of the main body part 51). In the above manner, a blower 83 is formed by the blower fan 71, the duct 79, the first blowing port 73 and the hood 75. The blowers 83 blow air to both upstream side corner portions of the sheet S discharged by the discharge rollers pair 29 downward (from the upper side).

The coupling part 53 is an approximately fan-like shaped member, and has a cursor side coupling portion 87 and a drive part side coupling portion 89 which are provided so as to be substantially orthogonal with each other. The cursor side coupling portion 87 is formed into an approximately fan-like shaped plate. The cursor side coupling portion 87 has an arc-shaped guide groove 87*a*. The drive part side coupling portion 89 has a pair of grip portions 91 disposed in parallel via a predetermined interval in the upper-and-lower direction.

The outer plate 57 and the inner plate 59 of the main body part 51 are coupled with each other as described above with the cursor side coupling portion 87 disposed between both plates 57 and 59. The projection 57*b* of the outer plate 57 is inserted into the opening 59*a* of the inner plate 59 through the guide groove 87*a* of the cursor side coupling portion 87. When the projection 57*b* is moved along the guide groove 87*a*, it becomes possible to change an angle of the main body part 51 with respect to the coupling part 53.

Figure 6:
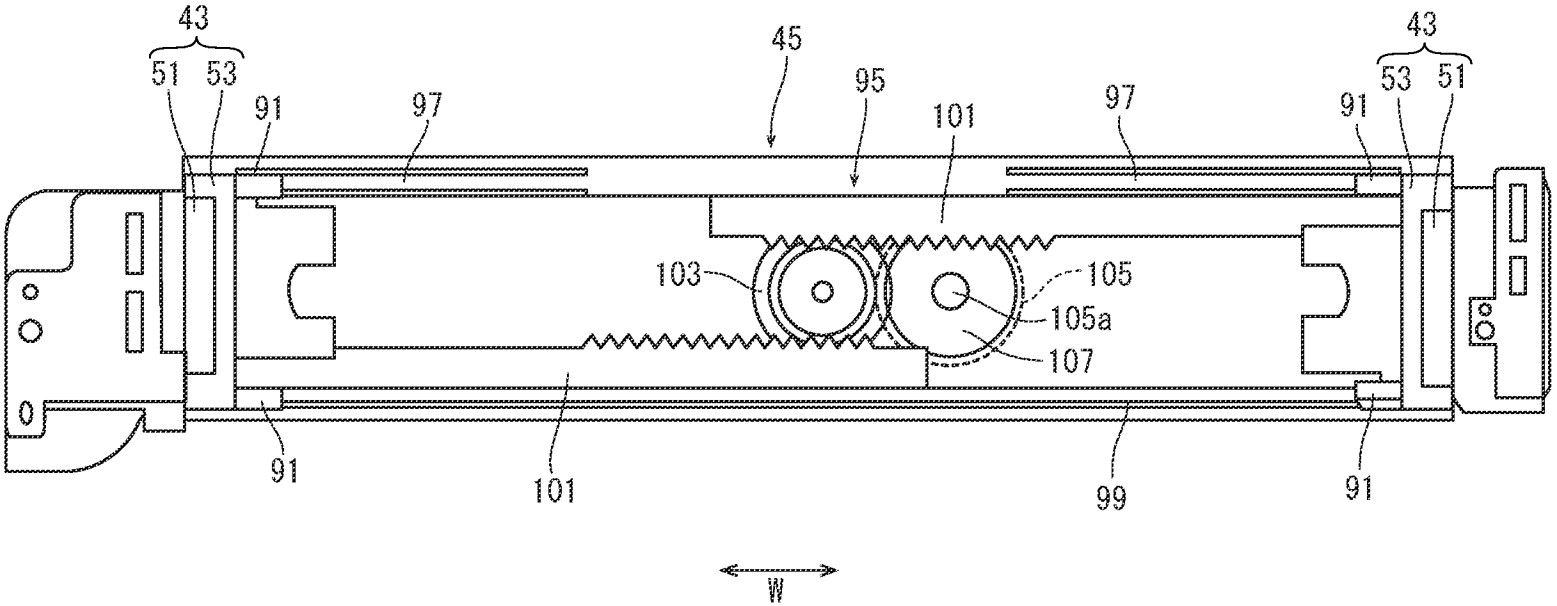
FIG. 6 is a front view showing a cursor drive mechanism, in the image forming apparatus according to the embodiment of the present invention.

Next, with reference to FIG. 6 to FIG. 8, a cursor driver 95 for sliding the pair of cursors 43 in a direction of approaching and separating from each other along the width directions W will be described. FIG. 6 is a front view showing the cursor driver, FIG. 7 is a sectional view showing the cursor driver and FIG. 8 is a perspective view showing a rack connected to the coupling part.

Figure 7:
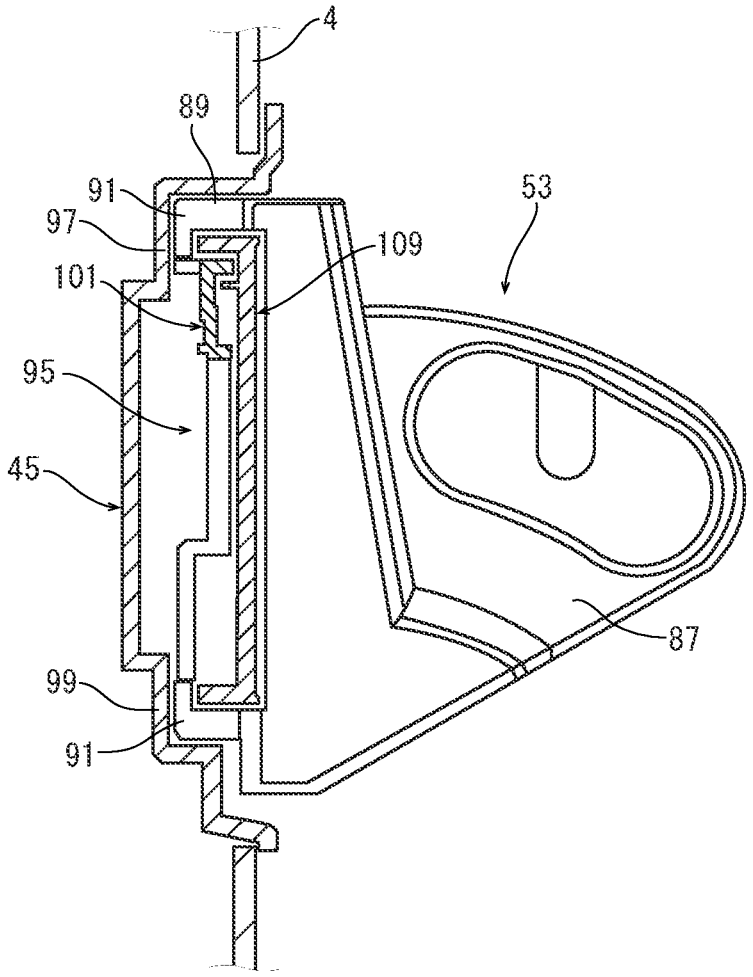
FIG. 7 is a sectional view showing the cursor drive mechanism, in the image forming apparatus according to one embodiment of the present invention.

As shown in FIG. 6 and FIG. 7, the cursor driver 95 is supported by a supporting member 45. The supporting member 45 is a rectangular plate member long in the width directions W, and mounted on the discharge wall 4 of the apparatus main body 3 below the discharge port 25 and above the sheet stacking plate 41 along the width directions W. The supporting member 45 has an upper rail 97 and a lower rail 99 which extends along the width directions W via a predetermined interval in the upper-and-lower direction.

The cursor driver 95 has a pair of rack gears 101, a pinion gear 103 engaged with the pair of rack gears 101, and a motor 105 for driving the pinion gear 103. The motor 105 is connected to a power source provided in the apparatus main body 3.

Figure 8:
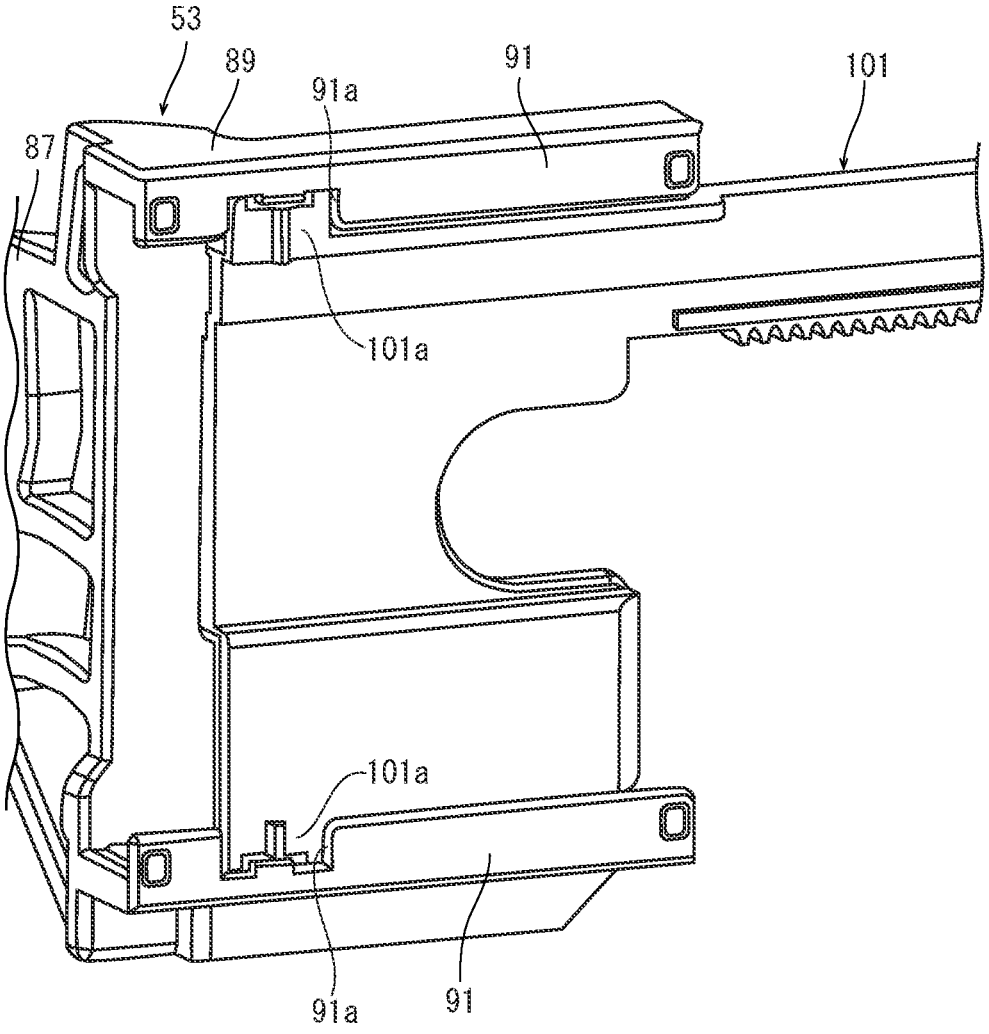
FIG. 8 is a perspective view showing a rack gear coupled to a coupling part, in the image forming apparatus according to one embodiment of the present invention.

As shown in FIG. 8, the rack gear 101 is held between the grip portions 91 of the drive part side coupling portion 89 of the coupling part 53. Specifically, each grip portion 91 has a recess 91*a*, and the rack gear 101 has projections 101*a* engageable with the recesses 91*a*. The rack gear 101 is elastically deformed and bent, and then each projection 101*a* is engaged with each recess 91*a*, so that the rack gear 101 is held by the pair of grip portions 91. The rack gears 101 are arranged such that the respective gears face each other, and the pair of grip portions 91 of the coupling part 53 is slidably engaged with the upper and lower rails 97 and 99 of the supporting member 45. When the coupling parts 53 are supported by the supporting member 45 in the above manner, the main body parts 51 coupled to the coupling parts 53 are supported on the sheet stacking plate 41 so as to face each other in the width directions W.

The pinion gear 103 is supported by the supporting member 45 between the upper and lower rails 97 and 99 in a rotatable manner, and engaged with the gears of the pair of rack gears 101. When the pinon gear 103 is rotated, the rack gears 101 are slid along the upper and lower rails 97 and 99 in an opposite direction along the width directions W. As a result, the main body parts 51 coupled to the rack gears 101 via the coupling parts 53 are slid on the sheet stacking plate 41 in the direction of approaching and separating from each other.

The motor 105 can rotate in one direction and in the other direction, and has a drive gear 107 fixed to an output shaft 105*a*. The motor 105 is supported by the supporting member 45, and the drive gear 107 is engaged with the pinion gear 103. When the motor 105 rotates in one direction and in the other direction, the cursors 43 is slid on the sheet stacking plate 41 through the pinion gear 103 and the pair of rack gears 101 synchronously with each other in the directions of approaching and separating from each other. As shown in FIG. 7, the cursor driver 95 is covered with a cover plate 109 so as not to be exposed.

The cursor driver 95 slides the pair of cursors 43 between a retraction position and an alignment position. The retraction position may be, for example, a position on an outer side in the width directions W than a position corresponding to both side edges of the maximum width sheet. The alignment position is a position corresponding to both side edges of the sheet S to be discharged, and is different depending on the size of the sheet S. That is, the motor 105 is rotated by the number of rotations corresponding to a distance from the reference position (the retraction position) to the alignment position corresponding to a size of the sheet S. When the motor 105 rotates in one direction, the pair of cursors 43 is slid from the retraction position to the alignment position, and when the motor 105 rotates in the other direction, the pair of cursors 43 is slid from the alignment position to the retraction position.

Figure 9:
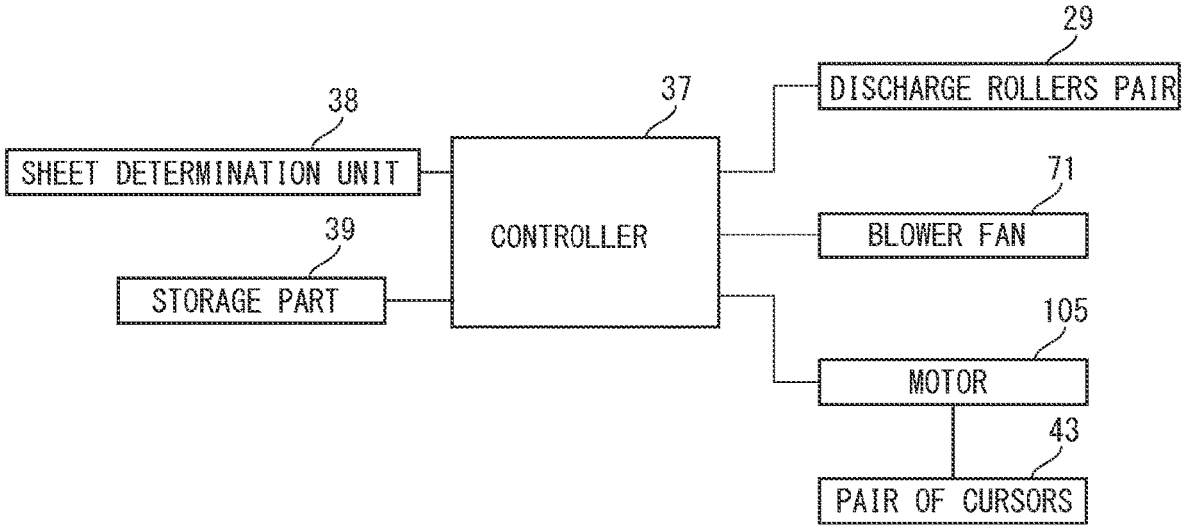
FIG. 9 is a block diagram of s controller, in the image forming apparatus according to the embodiment of the present invention.

Next, with reference to the block diagram shown in FIG. 9, the controller 37 will be described. The motor for rotating the drive roller of the discharge rollers pair 29, the blower fan 71, and the motor 105 for sliding the pair of cursors 43 are connected to the controller 37. The controller 37 is connected to a sheet determination unit 38 to which a thickness and a size of the sheet S are input. The sheet determination unit 38 may determine a thickness or a size of the sheet S by manual inputting by a user, or may determine a thickness and a size of the sheet S based on a detection result of a sensor that detects a thickness and a size of the sheet S.

Further, the controller 37 is connected to a storage part 39. The storage part 39 stores a moving distance of the cursor 43 from the retraction position to the alignment position for each size of the sheet S. Further, the storage part 39 stores a falling period of the sheet from a time when the rear end of the sheet passes through the nip of the discharge rollers pair 29 and the sheet S is completely discharged through the discharge port 25 to a time when both corner portions of the sheet S fall below the hood 75. The falling period is measured in advance by an experiment or the like. The falling period may be set for each thickness or each size of the sheet S.

The sheet discharge operation to discharge the sheet to the discharge tray 31 having the above configuration will be described with reference to FIG. 2, FIG. 5 and the others.

In an initial state, the pair of cursors 43 is slid to the retraction position. When the image forming operation is started, a size of the sheet S is sent from the sheet determination unit 38 to the controller 37. The controller 37 reads a moving distance of the cursor 43 corresponding to the sheet size sent from the storage part 39.

When the sheet S on which the image is formed is discharged through the discharge port 25, the sheet S falls on the sheet stacking plate 41 of the discharge tray 31. At this time, after the falling period stored in the storage part 39 is elapsed since the rear end of the sheet S passes through the nip between the discharge rollers 29, the controller 37 rotates the motor 105 in one direction so as to slide the cursor 43 for the read moving distance and drives the blower fan 71. That is, after both corner portions of the sheet S fall below the hoods 75, the controller 37 rotates the motor 105 and drives the blower fan 71. The fact that the rear end of the sheet has passed through the nip of the discharge rollers 29 is detected by a sheet detection sensor (not shown) provided in the discharge port 25.

While the blower fan 71 is being driven, outside air is taken into the duct 79 through the intake port 63*a*, the taken in air is sent through the duct 79 and then blown downward through the first blowing port 73 by the hood 75 (from the above side). As shown in FIG. 5, after both corner portions of the discharged sheet S fall below the hoods 75, the blower 83 blows air to both corner portions of the sheet S downward while the pair of cursors 43 is slid from the retraction position to the alignment position. Then, the pair of cursors 43 is slid to the alignment position to position the sheet S in the width directions W. After that, the blower 83 is blowing air to both corner portions of the sheet S downward. As described above, even during the falling of the sheet S and after the sheet S is fallen and then stacked on the sheet stacking plate 41, the blower 83 is blowing air to both corner portions of the sheet S downward (refer to the blanked arrows in FIG. 5). The blown air is exhausted to the outside through the wind releasing holes 81.

Thereafter, the controller 37 rotates the motor 105 in the other direction to slide the pair of cursors 43 from the alignment position to the retraction position. Thus, for every time when one sheet is discharged, the pair of cursors 43 reciprocates between the retraction position and the alignment position. While the controller 37 rotates the motor 105 in the other direction to slide the pair of cursors 43 from the alignment position to the retraction position, the controller 37 stops driving the blower fan 71.

As described above, in the image forming apparatus 1 of the present invention, regardless of a size of the sheet S, it becomes possible to blow air to both rear corner portions of the discharged sheet S by the blower 83 reliably. Therefore, if the rear end portion of the sheet S curls upward, the curled rear corner portions are pressed downward with an air pressure so that the curl is corrected. Accordingly, the curl of the rear end portion of the sheet S can be corrected for each sheet, and the sheets S can be properly positioned even when the sheets are discharged continuously.

Further, during the sliding of the pair of cursors 43 from the retraction position to the alignment position and after the pair of cursors 43 is slid to the alignment position, the blower fan 71 keeps to be driven. As a result, the air is being blown to both corner portions of the sheet S during the falling of the sheet and after the sheet is stacked on the sheet stacking plate 41. Therefore, since the air is blown to both corner portions of the sheet S for a relatively long time, the curl can be surely corrected. After the pair of cursors 43 is slid from the retraction position to the alignment position, the blower fan 71 may be started to be driven.

Furthermore, since the pair of cursors 43 is slid to the retraction position after one sheet is discharged, they do not interfere with the next discharged sheet.

The cursor driver 95 of the pair of cursors 43 is supported by the supporting member 45 attached to the discharge wall 4. Therefore, compared with a case where the cursor driver 95 is supported by the sheet stacking plate 41, the sheet stacking plate 41 can be reduced in size and weight.

In the present embodiment, air flow volume of the blower fan 71 is preferably variable. In this case, the air flow volume is varied according to a thickness and a size of the sheet S. When the sheet determination unit 38 (refer to FIG. 9) determines that the sheet S is thinner than the reference thickness or the sheet S is larger than the reference size, the controller 37 increases the air flow volume of the blower fan 71. If a thickness of the sheet S is thinner than the reference thickness, the sheet tends to curl easily. Then, the air flow volume is increased so as to press the rear end portions of the sheet downward with a higher air pressure. If a size of the sheet is larger than the reference size, the air flow volume is increased to press the rear corner portions of the sheet with a higher air pressure, so that it becomes possible to correct the curl of the entire width directions of the sheet.

In the present embodiment, the timing at which both corner portions of the sheet S fall below the blowers 83 is determined by the falling period from a time when the sheet S is completely discharged through the discharge port 25 to a time when both corner portions fall below the hoods 75. However, a position (a height) of the sheet S may be measured by a sensor. For example, in the case of using a transmission type optical sensor in which a light emitting part and a light receiving part are separated, the light emitting part is disposed below the hood 75 of the main body part 51 of one cursor 43 while the light receiving part is disposed below the hood 75 of the main body part 51 of the other cursor 43. When the falling sheet S blocks the optical path between the light emitting part and the light receiving part, the optical sensor detects the sheet S and sends a signal to the controller 37, and the controller 37 determines that the sheet S has fallen below the hoods 75. Alternatively, in the case of using a reflection type optical sensor in which a light emitting part and a light receiving part are disposed adjacently, the reflection type optical sensor is disposed below the hood 75 of the main body part 51 of one of the cursors 43. When the light emitted from the light emitting part is reflected by the falling sheet S and then received by the light receiving part, the optical sensor detects the sheet S and sends a signal to the controller 37, and the controller 37 determines that the sheet S has fallen below the hoods 75. The reflection type optical sensor may be disposed on the supporting member 45.

In the present embodiment, the duct 79 is formed in the main body part 51 of the cursor 43 along the upper edge, and the blower fan 71 is disposed on a side far from a side of the apparatus main body 3. Therefore, when the pair of cursors 43 is slid, the blower fan 71 is prevented from interfering with the apparatus main body 3.

The duct 79 may be formed on the inner surface of the main body part 51 so as to extend in the upper- and-lower direction along the upstream side edge in the discharge direction, and the fan 71 may be disposed at the upper end portion of the inside of the duct 79. As a result, an air passage is formed so as to extend from the intake port formed in the upper end portion of the duct 79 to the blowing port formed in the lower end portion of the duct. When the fan 71 is driven, the air taken into the duct through the intake port is blown downward through the blowing port. In this case, since the duct 79 can be reduced in length, a loss of air flow volume can be reduced, so that it becomes possible to blow air to both corner portions of the sheet S with a higher air pressure.

Figure 10:
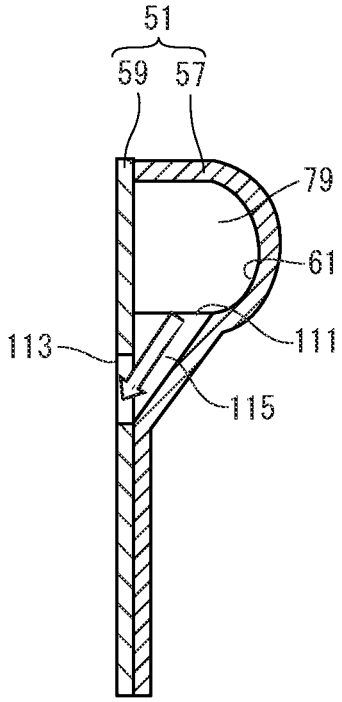
FIG. 10 is a sectional view showing a modified example the cursor, in the image forming apparatus according to the embodiment of the present invention.

Although the hood 75 protrudes from the main body part 51 in the present embodiment, the hood 75 may not be provided. In this case, as shown in FIG. 10, an opening 111 may be formed in the lower surface of the recessed portion 61 of the outer plate 57 of the main body part 51, a second blowing port 113 may be formed in the inner plate 59, and an air passage 115 may be formed between the outer plate 57 and the inner plate 59 so as to extend from the opening 111 to the second blowing port 113 obliquely downward. As indicated by the arrow in FIG. 10, the air sent into the duct 79 is blown to the corner portions of the sheet S obliquely along the air passage 115. In this case, since there is no member protruding inward from the main body part 51 in the width directions W, the appearance of the cursor 43 may be improved, and the sheet S can smoothly fall or be stacked. When the hood 75 is provided, the moving distance of the pair of cursors 43 needs to be increased by the protruding length of the hood 75 so as not to interfere the hood 75 with the sheet S, but since the hood 75 is not provided, the moving distance of the pair of cursors 43 can be shortened and the alignment operation can be performed in a short time.

While the present invention has been described with respect to specific embodiments, the present invention is not limited to the embodiments described above. Those skilled in the art can modify the above embodiments without departing from the scope and spirit of the present invention.

The invention claimed is:

1. An image forming apparatus comprising:

a discharge port through which a sheet having an image is discharged;

a sheet stacking plate on which the sheet discharged through the discharge port is stacked;

a pair of cursors supported on the sheet stacking plate in a slidable manner in width directions perpendicular to a discharge direction of the sheet and coming into contact with both side edges of the sheet;

a cursor driver driving the pair of cursors;

a pair of blowers provided in the pair of cursors so as to blow air to both corners on an upstream side in the discharge direction of the sheet which is discharged through the discharge port, from above; and a controller controlling the cursor driver and the pair of blowers, wherein the controller includes a storage part which stores a falling time from when both the corners of the sheet are discharged through the discharge port to when both the corners of the sheet fall below the pair of blowers, for each thickness and each size of the sheet, and the controller drives the pair of blowers after the falling time corresponding to a thickness and a size of the sheet discharged through the discharge port elapses.

2. The image forming apparatus according to claim 1, wherein the pair of cursors is supported in a slidable manner in the width directions between an alignment position where the pair of cursors come into contact with both the side edges of the sheet and a retraction position where the pair of cursors is separated outside in the width directions from the alignment position, and the controller controls the cursor driver such that the pair of cursors is slid from the retraction position to the alignment position after both the corners of the sheet discharged through the discharge port fall below the pair of blowers and then controls the pair of blowers to blow air to both the corners of the sheet.

3. The image forming apparatus according to claim 1, wherein the pair of cursors is supported in a slidable manner in the width directions between an alignment position where the pair of cursors come into contact with both the side edges of the sheet and a retraction position where the pair of cursors is separated outside in the width directions from the alignment position, and the controller controls the cursor driver such that the pair of cursors is slid from the retraction position to the alignment position after both the corners of the sheet discharged through the discharge port fall below the pair of blowers and controls the pair of blowers to blow air to both the corners of the sheet while the pair of cursors is sliding from the retraction position to the alignment position.

4. The image forming apparatus according to claim 1, wherein each of the pair of cursors has a main body part in which each of the pair of blowers is provided, each of the pair of blowers includes:

a fan which takes in air through an intake port provided on an outer surface of the main body part in the width directions at a downstream side portion in the discharge direction;

a duct formed on the outer surface so as to extend from the intake port upstream in the discharge direction and through which the air taken in from the intake port is sent by the fan;

a first blowing port communicated with the duct and provided on an inner surface of the main body part in the width directions at an upstream side portion in the discharge direction; and a hood disposed on the first blowing port and guiding the air sent through the duct so as to blow downward through the first blowing port.

5. The image forming apparatus according to claim 4, further comprising a sheet determination unit configured to compare a thickness and a size of the sheet stacked on the sheet stacking plate with a thickness and a size of a reference sheet, the fan is configured to be variable in an air flow volume, the controller controls the fan so as to increase the air flow volume more than a reference air flow volume in a case where a thickness of the sheet is thicker than the thickness of the reference sheet or in a case where a size of the sheet is larger than the reference size of the reference sheet, based on a determination of the sheet determination unit.

6. The image forming apparatus according to claim 1, comprising a discharge wall in which the discharge port is formed and by which the sheet stacking plate is supported, wherein the cursor driver is provided in the discharge wall.

7. An image forming apparatus comprising:

a discharge port through which a sheet having an image is discharged;

a sheet stacking plate on which the sheet discharged through the discharge port is stacked;

a pair of cursors supported on the sheet stacking plate in a slidable manner in width directions perpendicular to a discharge direction of the sheet and coming into contact with both side edges of the sheet;

a cursor driver driving the pair of cursors;

a pair of blowers provided in the pair of cursors so as to blow air to both corners on an upstream side in the discharge direction of the sheet which is discharged through the discharge port, from above; and a controller controlling the cursor driver and the pair of blowers, wherein each of the pair of cursors has a main body part in which each of the pair of blowers is provided, each of the pair of blowers includes:

a fan which takes in air through an intake port provided on an outer surface of the main body part in the width directions at a downstream side portion in the discharge direction;

a duct formed on the outer surface so as to extend from the intake port upstream in the discharge direction and through which the air taken in from the intake port is sent by the fan;

a first blowing port communicated with the duct and provided on an inner surface of the main body part in the width directions at an upstream side portion in the discharge direction;

a hood disposed on the first blowing port and guiding the air sent through the duct so as to blow downward through the first blowing port; and each of the pair of blowers includes a wind releasing hole formed below the first blowing port so as to penetrate the main body part between the inner surface and the outer surface.

8. An image forming apparatus comprising:

a discharge port through which a sheet having an image is discharged;

a sheet stacking plate on which the sheet discharged through the discharge port is stacked;

a pair of cursors supported on the sheet stacking plate in a slidable manner in width directions perpendicular to a discharge direction of the sheet and coming into contact with both side edges of the sheet;

a cursor driver driving the pair of cursors;

a pair of blowers provided in the pair of cursors so as to blow air to both corners on an upstream side in the discharge direction of the sheet which is discharged through the discharge port, from above; and a controller controlling the cursor driver and the pair of blowers, wherein each of the pair of cursors has a main body part in which each of the blowers is provided, each of the pair of blowers includes:

a fan which takes in air through an intake port provided on an outer surface of the main body part in the width directions at a downstream side portion in the discharge direction;

a duct formed on the outer surface so as to extend from the intake port upstream in the discharge direction and through which the air taken in from the intake port is sent by the fan;

an opening formed in a lower surface of the duct on an upstream side in the discharge direction;

a second blowing port provided below the opening; and an air passage extending from the opening to the second blowing port.

* * * * *